United States Patent [19]

Hedberg

[11] 4,106,073

[45] Aug. 8, 1978

[54] APPARATUS FOR IGNITING THE MATCH HEADS OF ELECTRIC DETONATORS

[76] Inventor: John Bengt Göran Hedberg, Fregattgatan 13, Västra Frölunda, Sweden

[21] Appl. No.: 604,154

[22] Filed: Aug. 13, 1975

Related U.S. Application Data

[63] Continuation of Ser. No. 409,242, Oct. 24, 1973, abandoned.

[51] Int. Cl.[2] ..... F42B 3/10

[52] U.S. Cl. ..... 361/248; 102/203

[58] Field of Search ..... 318/80; 102/70.2 R, 102/70.2 A; 321/18; 317/80; 361/248, 251

[56] References Cited

U.S. PATENT DOCUMENTS

| | | | |
|---|---|---|---|
| 3,075,125 | 1/1963 | McAuslan et al. | 317/80 |
| 3,409,804 | 11/1968 | Bankston, Jr. | 317/80 |
| 3,417,306 | 12/1968 | Knak | 317/80 |
| 3,418,557 | 12/1968 | Schaefer | 321/18 |

FOREIGN PATENT DOCUMENTS

| | | | |
|---|---|---|---|
| 1,281,112 | 11/1961 | France | 102/70.2 |
| 1,335,015 | 7/1963 | France | 361/251 |

*Primary Examiner*—J. V. Truhe
*Assistant Examiner*—Clifford C. Shaw
*Attorney, Agent, or Firm*—Stevens, Davis, Miller & Mosher

[57] ABSTRACT

An apparatus for obtaining reliable ignition of the match heads of series-connected electric detonators, the apparatus including a dischargeable source of energy capable of supplying to the match heads sufficient energy to ignite the same and circuitry for regulating the current through the match heads during the discharge of the energy source. The apparatus is also arranged to cooperate with circuitry for initiating the discharge of the energy source.

5 Claims, 11 Drawing Figures

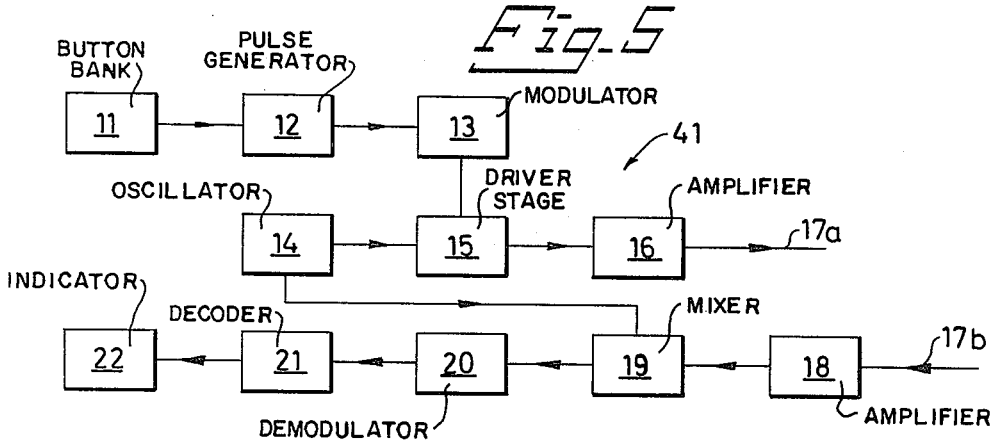
Fig. 5
BUTTON BANK
PULSE GENERATOR
MODULATOR
41
OSCILLATOR
DRIVER STAGE
AMPLIFIER
17a
INDICATOR
DECODER
MIXER
17b
DEMODULATOR
AMPLIFIER
11
12
13
14
15
16
18
19
20
21
22

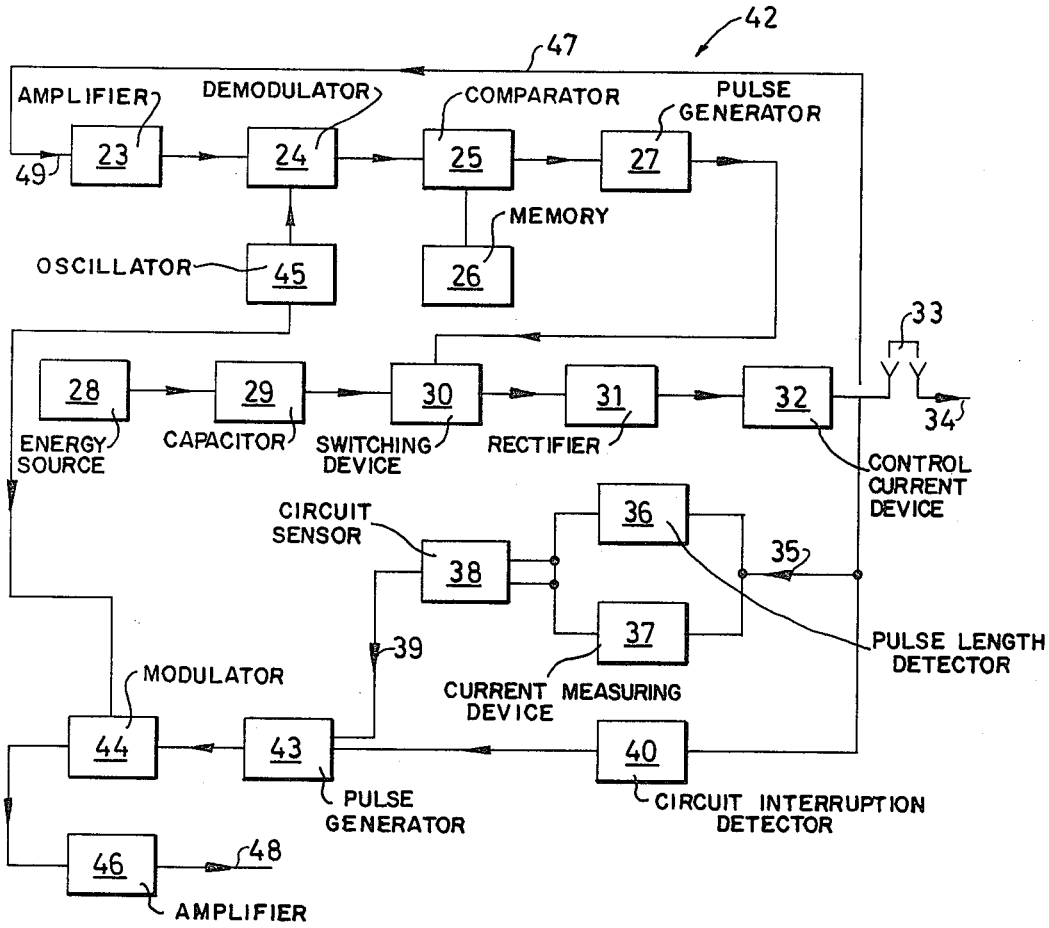
42
47
AMPLIFIER
DEMODULATOR
COMPARATOR
PULSE GENERATOR
49
MEMORY
OSCILLATOR
33
34
ENERGY SOURCE
CAPACITOR
SWITCHING DEVICE
RECTIFIER
CONTROL CURRENT DEVICE
CIRCUIT SENSOR
35
PULSE LENGTH DETECTOR
39
MODULATOR
CURRENT MEASURING DEVICE
PULSE GENERATOR
CIRCUIT INTERRUPTION DETECTOR
48
AMPLIFIER
23
24
25
27
26
45
28
29
30
31
32
36
38
37
44
43
40
46

CHOKE
POLE CHANGER
RECTIFIER
118
119
221
222
201
202
200
TRANSFORMER
CAPACITOR
203
SWITCH
VOLTAGE DIVIDER
204
CAPACITOR
VOLTAGE REGULATOR
COMPARATOR
220
207
SWITCH
205
VOLTAGE SOURCE
208
206
217
OSCILLATOR
LOW-PASS FILTER
RECTIFIER
218
209
210
TRANSFORMER
211
212
SMOOTHING DEVICES
219
213
MATCHING TRANSFORMERS
214
225
226
216
215
227
229
VOLTAGE REGULATOR
223
228
224
CONSTANT CURRENT DEVICE 227
229
504
515
BISTABLE FLIP-FLOP
500
TIME CIRCUITS
516
501c
501
508
501a
507
502
503
505
506
514
REFERENCE VOLTAGE SOURCE
TIME CIRCUITS
511
510
509
BISTABLE FLIP-FLOP
RECTIFIER
513
501
501c
512
223
501b
224

227
229
601
601c
601a
602
603
BISTABLE FLIP-FLOP
604
615
608
TIME CIRCUITS
616
BISTABLE FLIP-FLOP
605
609
606
TIME CIRCUITS
621
622
610
611
626
623
620
607
613
627
REFERENCE VOLTAGE SOURCES
617
223
601c
628
625
601
618
619
601b
624
612
224

APPARATUS FOR IGNITING THE MATCH HEADS OF ELECTRIC DETONATORS

This is a continuation of application Ser. No. 409,242, filed Oct. 24, 1973, now abandoned.

The present invention relates to an apparatus for igniting the match heads of a plurality of series-connected electric detonators.

When blasting rock, for example in conjunction with mining operations, road working operations and the like, a relatively large number of drill holes are normally made in the rock face, each hole being intended to accommodate an explosive charge in which there is imbedded a detonator for firing the charge. The detonators used are often electric detontors which are connected in series by means of electric conductors to an apparatus operative in igniting the match head of the detonator and placed at a safe location remote from the blasting site, the ignition apparatus being used to cause the simultaneous detonation of all the explosive charges needed to obtain a desired blasting salvo. The electric detonators may be provided with delay charges, and by using electric detonators having delay charge of different delays, i.e. so that a short delay of the order of one or more tens of milliseconds is had between the firing of respective detonators, it is possible, provided that firing of all detonators is initiated simultaneously, to obtain different blasting patterns which can be accurately controlled, for example a blasting pattern in which the loosened material falls in a desired, predetermined direction and is broken up to an extent which enables it to be readily removed from the blasting site by available machines in a convenient manner.

The ignition apparatus used hitherto in mining operations and with other operations requiring comprehensive blasting work, normally comprises an energy source in the form of a capacitor or a capacitor-pack which is charged by means of a manually operated generator, for example, the ignition apparatus being connected to the electric detonators located at the blasting site by means of insulated conductors having a length of up to 1000 meters. The energy source must be charged to a high voltage, often to an order of magnitude of some thousands of volts, in order that the amount of ignition energy needed to ignite a large number of detonators can be stored. When initiating the firing of electric detonators, the energy source is electrically discharged via said conductors and the detonators, the voltage at the beginning of the energy source discharge sequence being extremely high, but falling rapidly with time. The high voltage present at the beginning of the energy source discharge period causes great strains and stresses to be placed on the conductors, and sparking from the conductors to earth is not uncommon. Because of this a large portion of the energy stored in the energy source may be lost and in unfortunate circumstances only some of the detonators may be fired making subsequent clearing work on the blasting site extremely dangerous.

When using electric detonators provided with delay charges, the high voltage present at the beginning of the aforementioned discharge period is also liable to cause one or more of the match heads on the electric detonators to explode instead of being ignited in the manner intended, which can result in the rupture of the cylindrical detonator casing or in the ejection of the plug which seals between said cylindrical casing and the connecting wires. This can cause uncontrollable changes in the delay time, whereby the delay increases from an intended value of, for example, some tens of milliseconds to some seconds, thereby uncontrollably changing the intended blasting pattern.

One object of the invention is to provide an ignition apparatus suitable for use with comprehensive blasting work, which generally eliminates the aforementioned risks.

Another object of the invention is to provide an ignition apparatus with which the current flowing through the match heads of the electric detonators is automatically interrupted at a point of time which ensures that none of the detonators connected to the apparatus will be fired if the apparatus senses that the amount of energy which can be supplied to the detonator match heads will not be sufficient to cause all the detonators to be fired, said energy deficiency being caused, for example, by energy leaking from the circuit incorporating the detonators upon ignition of the match leads, or by overloading the ignition apparatus, for example by including an excessive number of detonators in said circuit.

A further object of the invention is to provide an ignition apparatus which is capable of reliably firing a large number of electric detonators connected in series without the conductors extending from said apparatus being subjected to excessively high voltage peaks.

Yet another object of the invention is to provide an ignition apparatus which can be remotely controlled.

Another object of the invention is to provide an ignition apparatus which can be remotely controlled and the energy source of which can be charged to a relatively high voltage by means of a voltage source of relatively low voltage.

These objects are obtained in accordance with the invention by means of an apparatus for initiating the firing of a plurality of series-connected electric detonators, said apparatus including a dischargeable energy source which is capable of being connected to the detonators and which during its discharge period is capable of producing the electrical energy required for simultaneous firing of the maximum number of electric detonators which the apparatus is designed to handle, and means for controlling the current flowing through the match heads during the energy source discharge period so that said current has a substantially constant, predetermined value irrespective of the number of detonators incorporated in the firing circuit, and means for initiating the discharge of said energy source. So that the invention will be more readily understood and further features thereof made apparent, ignition apparatus according to the invention will now be described with reference to the accompanying drawing, in which:

FIG. 5 illustrates very diagrammatically a first embodiment of an ignition apparatus according to the invention together with an associated control unit for remote control of said apparatus.

Figure 7:
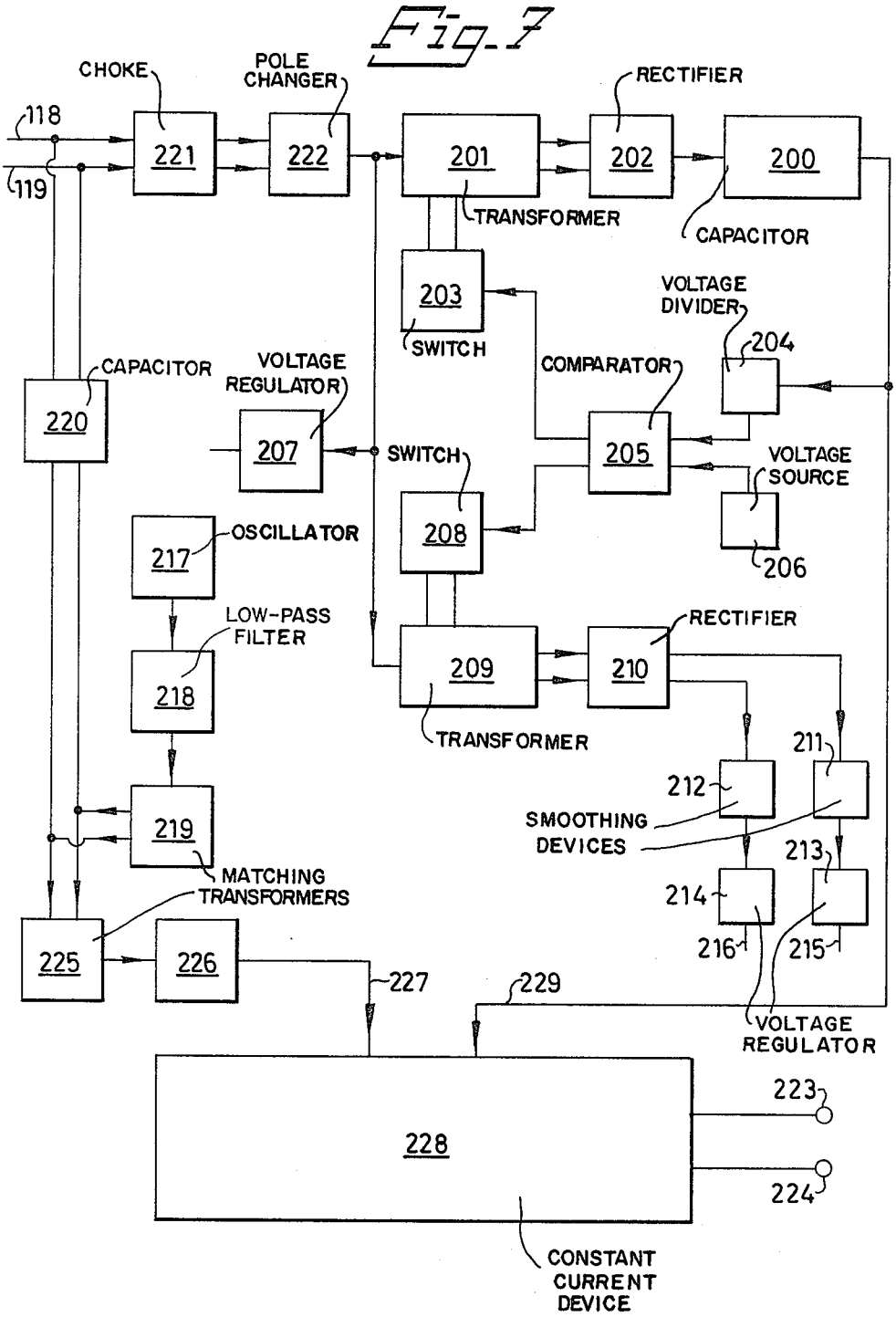

FIGS. 8–11 show in more detail four different arrangements for maintaining a constant current through the match heads of electric detonators connected to the ignition apparatus of FIG. 5 or FIG. 7 and for interrupting the current passing through the match heads at an early stage should the energy supplied thereto be beneath the level needed to heat the match head filaments to an extent sufficient to ignite the match heads.

Figure 1:
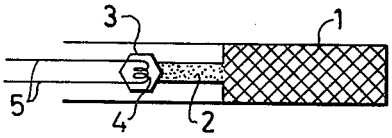
FIG. 1 is an axial sectional view of an electric detonator.
Figure 2:
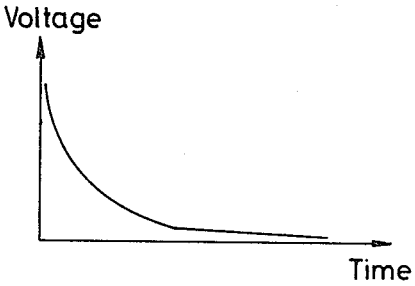
FIG. 2 shows the characteristic discharge curve for an energy source constructed of one or more capacitors, when no control measures are taken.

In the drawing, FIG. 1 shows a conventional electric detonator comprising a detonator charge 1 contained in a cylindrical casing, a delay charge 2, a match head 3 having an electric filament 4 imbedded therein, said filament being arranged to be connected to an ignition apparatus by means of connecting wires 5. At the end of the detonator casing remote from the explosive charge 1 there is normally arranged a sealing plug (not shown). With large blasting operations, a relatively large number of such electric detonators, for example from 25 to 100 detonators and in certain cases up to several thousand detonators, are normally connected to one and the same ignition apparatus, firing of all the detonators being initiated simultaneously by means of the ignition apparatus, wherewith there is normally used electric detonators having delay charges of different delays in accordance with certain rules, for obtaining the desired blasting pattern. Apart from changes caused by heating phenomena, the electric filaments in the detonators connected to the ignition apparatus act as a resistor having a substantially fixed resistance, over which an energy source in the form of a capacitor or a capacitor-pack incorporated in the ignition apparatus is discharged. When the discharge of such an energy source over the electric detonators for igniting the match heads is not controlled, there is obtained a discharge pattern of the type shown in FIG. 2, i.e. a pattern in which the voltage falls rapidly from an often extremely high initial value to which the energy source is charged, down towards the value zero. The current passing through the electric detonator match heads thus follows a curve similar to the illustrated voltage curve, creating risks of the type mentioned in the introduction.

Figure 3:
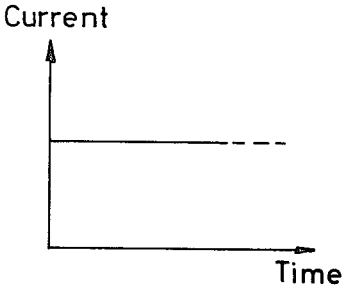
FIG. 3 shows the current-time curve desired with the apparatus of the invention when igniting the match heads of electric detonators simultaneously, while using a direct current as the igniting current.
Figure 4:
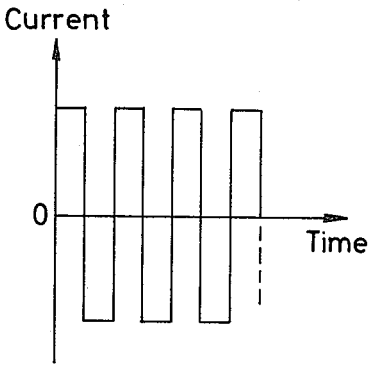
FIG. 4 shows the current-time curve desired with the apparatus of the invention when igniting the match heads of electric detonators simultaneously, while using alternating current as the ignition current.

In accordance with the present invention there is provided a detonator match head ignition apparatus with which the discharge of the energy source over connected detonators is controlled, so that the current flowing through the electric filaments upon ignition of the fuse heads has a substantially constant value, irrespective of the number of electric detonators connected to the energy source, i.e. so that when using a direct current as the ignition current, the current substantially folows a curve of the type shown in FIG. 3 and when using alternating current as the ignition current said current generally follows the curve of the type shown in FIG. 4, i.e. has a substantially constant effective value.

The ignition apparatus of the invention may be adapted for operation from locations far removed from the blasting site and may itself carry the operating means for controllably discharging the energy stored in its energy source to the electric detonators connected thereto, by means of relatively long conductors. It is preferred, however, to place the ignition apparatus relatively close to the blasting site, although the apparatus should be protected against falling debris, and to remotely control both the charging and discharging of the ignition apparatus energy source by means of a control unit located at a relatively short distance from the blasting site, wherewith a plurality of ignition apparatus are preferably connected to one and the same control unit and are arranged to be selectively remotely controlled by means of said unit.

FIG. 5 shows the principle construction of an apparatus according to the present invention suitable for initiating the firing of electric detonators.

In FIG. 5, the reference numeral 41 identifies generally an operating unit by means of which an ignition apparatus, identified generally by the reference numeral 42 can be controlled.

The operating unit 41 of the present invention has incorporated therein a bank of buttons 11 by means of which ignition apparatus connected to said buttons can be controlled and which is connected to a modulator 13 over a pulse generator 12, the modulator being arranged to send a signal to a driver stage 15. Connected upstream of the driver stage 15 is an oscillator 14 which is arranged to send a signal to the driver stage 15 which signal is processed in said stage by the signal arriving from the modulator 13. The oscillator 14 also sends a signal to a mixer 19 cooperating with terminal 17*b*. The signal leaving the driver stage is characteristic for the depressed button and is conducted, via a power amplifier 16, to a terminal 17*a*, which together with terminal 17*b* comprises the two terminal points for the conductors which join the operating unit to the remote ignition apparatus.

Connected to terminal 17*b* is an amplifier 18 which is arranged to amplify signals returned to the control unit from the ignition apparatus as hereinafter described with reference to FIGS. 6 and 7. Subsequent to being amplified in amplifier 18, the signal is mixed in mixer 19 with the signal received from the oscillator 14. A demodulator 20 is arranged to detect the mixed signal from mixer 19 and to drive an indicator means 22 by means of a decoder 21, as shown. The status of the ignition device, e.g. that charging of a capacitor 29 incorporated therein is completed, can be indicated to the operator in this way.

The signals received in the ignition apparatus over terminals 17*a*, 17*b* and cooresponding terminals of the ignition apparatus, are applied to a signal amplifier 23 in the ignition apparatus 42 through a terminal 49, said apparatus being intended to deliver a current to electric detonators subsequent to receiving an activating signal, the incoming signals being amplified in said amplifier 23 and being, subsequent thereto, mixed in a demodulator 24 with the signal delivered by an oscillator 45. The ignition apparatus has a numerical memory 26 in which there is stored an apparatus identifying signal. The demodulated signal is delivered to a comparison circuit 25 connected to the memory 26 and is compared in said circuit with the apparatus identifying signal stored in the numerical memory 26 of the ignition apparatus. When the signals from the numerical memory and the demodulator are identical, a DC voltage is transmitted to a pulse generator 27 which is connected downstream of the circuit 25 and which generates a pulse having a duration sufficient to initiate firing of connected detonators, said pulse being transmitted to a current path switching device 30, comprising basically a transformer and two transistors. A source of energy 28, for example a conventional torch battery, is arranged to charge, by means of a current path switching device (not shown), an energy storage device 29 in the form of, for example, a capacitor, which is connected to the device 30. The device 30 is arranged to generate a current of sufficient magnitude to initiate firing of the connected detonators during the time period determined by pulse generator 27.

Figure 8:
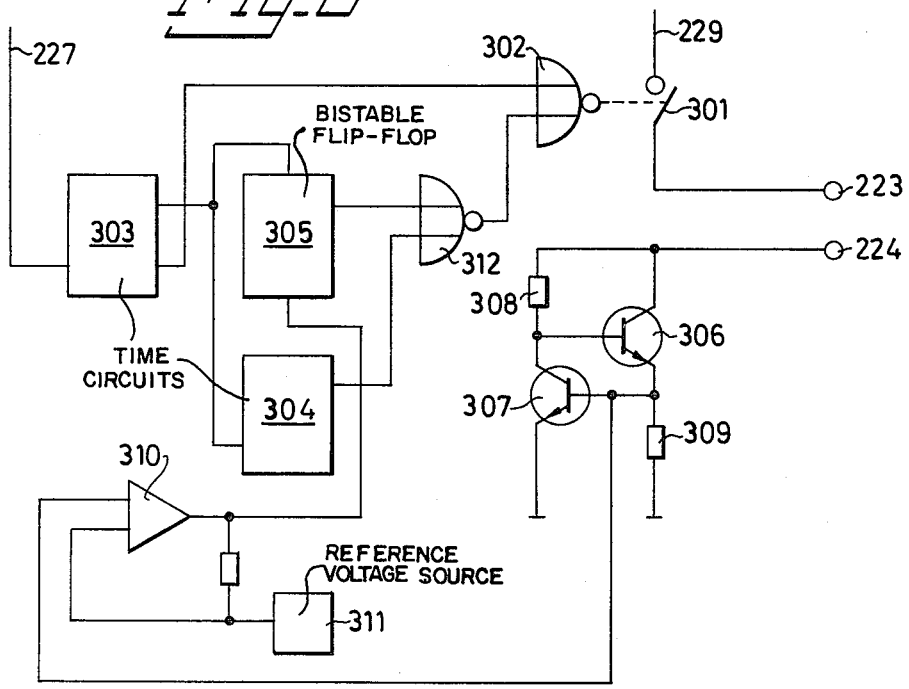

The current generated by the current path switching device 30 is rectified in a rectifier 31 and is applied to a constant current device 32, which device 32 is described in more detail in FIG. 8 and which is arranged to maintain the current flowing through the detonator match heads substantially constant. The output terminal of constant current device 32 is connected to a switch means, which is connected with one terminal 34 of the detonators by means of a short circuiting device 33, having the form of a detachable handle. The output terminal of constant current device 32 is also connected to a pulse length detector 36, as shown in the Figure, and a current measuring device 37 via a conductor 35. The pulse length detector 36 is adapted to detect whether the pulse delivered to the detonator match heads has sufficient duration, while the current measuring device 37 measures the current flowing through the match heads. Signals from the pulse length detector 36 and the current measuring device 37 are applied to a circuit sensor 38, which serses whether both the pulse length and the output current coincide with desired values and is arranged to produce on a conductor 39 passing to a pulse generator 43 a signal representing "correct pulse" when said pulse length and said output current coincide with said desired values.

The signal from the constant current device 32 is passed further to a circuit interruption detector 40 connected upstream of generator 43, the detector being arranged to detect a break in the circuit through the match heads as a result of the detonation of the electric detonators.

The signals from circuits 38 and 40 are applied to the pulse generator 43, which transmits a signal corresponding to the state of circuits 38, 40 to a mudulator 44, to which latter the oscillator 45 is also connected. A power amplifier 46 which receives the signal from the modulator 44 is arranged to transmit said signal to terminal 48, which is connected in a suitable manner with the terminals 17*a*, 17*b* of the operating unit 41.

Figure 6:
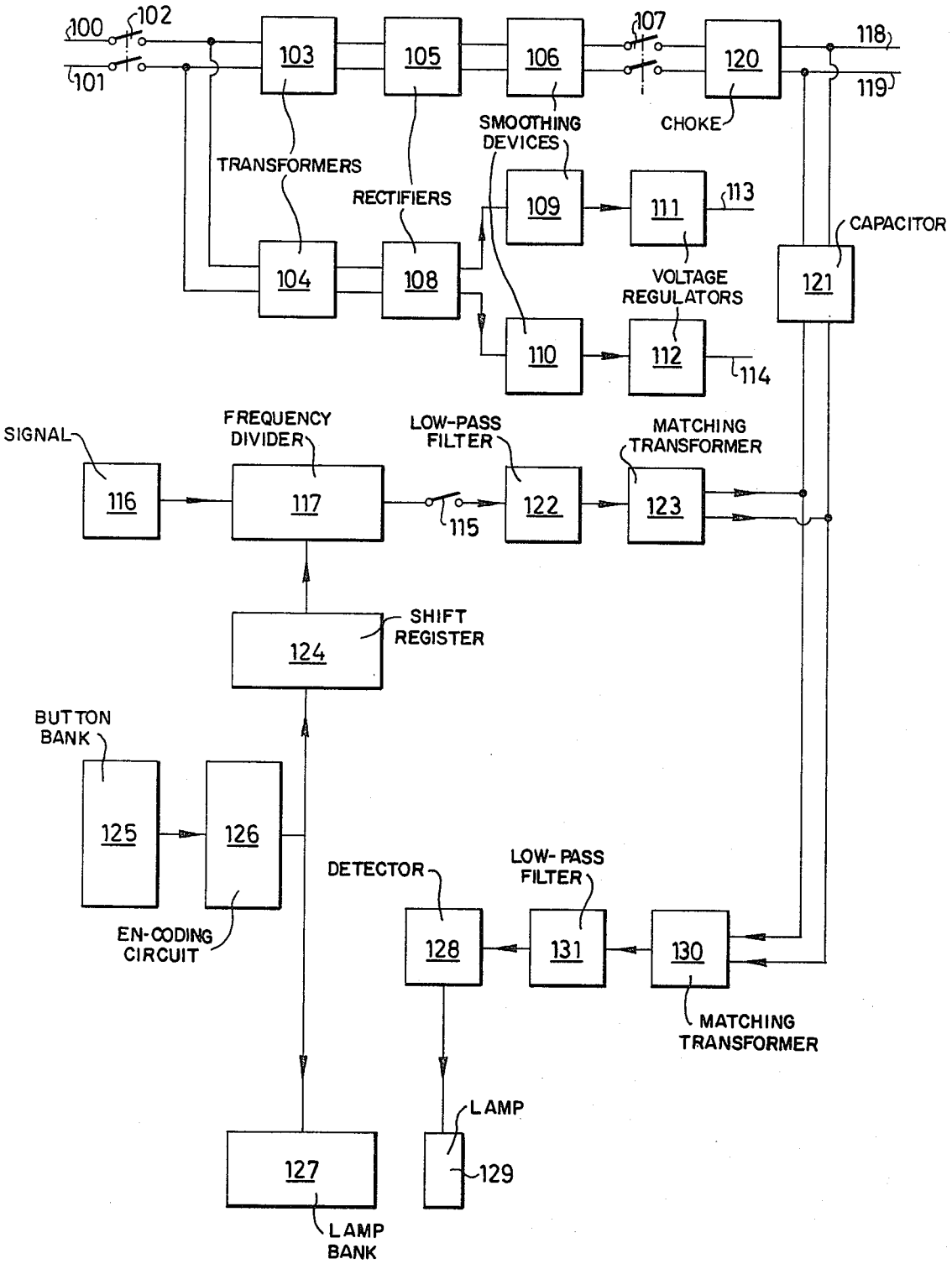
FIGS. 6 and 7 illustrate diagrammatically a second embodiment of the control unit and the ignition apparatus of the invention respectively.

FIG. 6 shows diagrammatically a control unit comprising current supply units for supplying current to one or more ignition apparatus of the type shown in FIG. 7 and to the current consuming components of the control unit, and an operating unit by means of which a selected ignition apparatus can be activated to transmit energy to the match heads of a number of electric detonators connected in series. With the embodiment of FIG. 6, two transformers 103, 104 are supplied with alternating current, for example from a conventional A.C. mains supply, via conductors 100, 101 and a switch means 102. The transformers 103, 104 are incorporated in their respective current supply unit and are adapted to transform the A.C. voltage applied to said transformers to a voltage suitable for the system components connected downstream thereof. The current supply unit serving the ignition apparatus also incorporates a rectifier 105 for converting A.C. voltage from the transformer 103 to a pulsating D.C. voltage; a voltage smoothing device 106 connected to the rectifier 105 and having, for example, the form of a capacitor located between the conductors leading from said rectifier, for converting the pulsating D.C. voltage to a substantially constant voltage; and a switch means 107, which is arranged on the output side of tghe device 106 and to which the substantially constant voltage is applied and which is normally open but which can be manually closed to cause the electric energy to be supplied to the connected ignition apparatus. The transformer 104 incorporated in the current supply unit of the control unit is provided with a secondary winding (not shown in FIG. 6), the center of which is connected to earth and the ends of which are connected to a conventional bridge rectifier 108 for full wave rectification, from which bridge positive and negative voltage pulses are passed to their respective ones of voltage smoothing devices 109, 110 connected thereto, which devices are adapted to convert the pulsating voltages applied thereto substantially constant voltages and each of which devices comprises, for example, a capacitor connected between the respective conductors for the positive and negative pulses and earth. The voltages from the smoothing device 109, 110 are passed to the current consuming components of the control means via known voltage regulators 111, 112 for maintaining the positive and negative voltages departing respectively at 113 and 114 constant. The voltage regulators 111, 112 may, for example, be of the type sold by National Semiconductor Corp., Santa Clara, California, USA, under the designations LM 309 and LM 320 respectively.

The operating unit (shown in the lower half of FIG. 6) comprises a manually actuable, normally open switch means which is connected downstream of a signal source 116 and a frequency divider 117 and 115 which when actuated closes a signal circuit so that a signal capable of activating an ignition apparatus and generated by said signal source 116 is able to reach said ignition apparatus. The signal source 116 comprises, for example, an oscillator which is energized through conductor 113 and the pulsating output signal of which is applied to one terminal of the switch means 115, optionally via the frequency divider 117, said output signal with the switch means 115 closed being applied to the ignition apparatus subsequent to being suitably processed in a manner hereinafter described. With the illustrated embodiment the ignition apparatus activating signal is applied to the ignition apparatus through the same conductors 118, 119 as those used to supply current to said apparatus. To avoid disturbance of the activating signal and damage to the signal source 116 and the components associated therewith chokes 120, which prevent the activating signal from passing in the wrong direction through the conductors 118, 119; capacitors 121, which prevent passage of the output current from the unit 103, 105, 106, 107; a low-pass filter 122, which is arranged to filter out possible harmonics so that the output activating signal from the contact 115 is ensured the form of a sinusoidal voltage; and a matching transformer 123 for matching the output inpedance of the low-pass filter with the impedance of the conductors 118, 119 are arranged between the switch means 107 and the switch means 115 in the shown manner, so that transmission of the actuating signal to the ignition apparatus can be effected essentially without disturbance.

If it is desired to use the control device for activating more than one ignition apparatus connected thereto while using one and the same signal source, it must be possible to change the frequency of the activating signal, the different ignition apparatus being designed to be actuated by a respective, specific activating signal alotted thereto. Changing of the frequency of the activating signal is effected by the frequency divider 117, which for example may be of the type sold by Texas Instruments Ltd., Dallas, Texas, USA (hereinafter referred to as TI), under the designation SN 74197 N, said frequency divider 117 being controlled by means of a shift register 124, for example of the type sold by TI under the designation SN 74165 N. The shift register 124 is, in turn, controlled by a bank of press buttons or the like 125 (not shown in detail) one button in the bank being arranged to co-act with a respective ignition apparatus. Each button is arranged to close a normally open two-terminal switch means (not shown) when depressed, one terminal of said switch means being connected to earth and the other terminal being connected, optionally via a resistance, to the conductor 113 and to an input of an encoding circuit 126 cooperating with the switch means in question. The encoding circuit 126 is arranged to send a binary code signal corresponding to the depressed button to the shift register 124 to shift the same in a manner such as to cause the frequency divider 117 to convert the signal arriving from the signal source 116 to an activating signal capable of activating the ignition apparatus served by the depressed button in question. Encoding circuits suitable for the present purpose are known to those skilled in the art and will not therefore be described in detail. It can be mentioned, however, that when using a button bank having up to nine buttons, the encoding circuit used may, to advantage, be of the type sold by TI under the designation SN 74147 N. To enable the steps taken to be visually controlled, a bank of lamps 127 capable of being actuated by the encoding switch may be coordinated therewith, each lamp in said bank 127-cooperating with its respective button in the button bank 125.

Irrespective of whether the control unit is used for one or more ignition apparatus, it is important to know that the ignition apparatus to be actuated via its respective current supply unit has received sufficient energy to ignite the match heads connected thereto. To this end each ignition apparatus is provided with a confirmation device, as hereinafter described, arranged to send to the control unit a confirming signal in the form of an AC voltage as soon as the ignition apparatus has received the requisite amount of energy, said signal being arranged to activate visual or acoustic indicating means in the control unit. With the illustrated embodiment, the confirmation signal is applied to a detector 128, which is arranged to receive a signal through conductors 118, 119 and to ignite a lamp 129 upon receipt of said signal. To avoid disturbances from the conductors 118, 119, the detector 128 receives the confirmation signal via a matching transformer 130, as shown in the drawing. Arranged between the matching transformer 130 and the detector 128 is a low-pass fitler 131, which is adapted to filter out the activating signal transmitted by the control unit. Owing to the fact that components 128–131 are arranged on the same side of the capacitors 121 as the operating unit, said components are protected from the D.C. voltage delivered by the ignition apparatus current supply unit.

FIG. 7 shows diagrammatically an ignition apparatus which is capable of being controlled by the control unit of FIG. 6 and which is arranged to be activated by current supplied thereto via conductors 118, 119 as long as the switch means 107 is held closed. The current applied to the ignition apparatus is caused to charge an energy storing means 200, having the form of one or more capacitors. Energy is supplied to the means 200 via an inverter, comprising a transformer 201, a rectifier bridge 202 and a device 203 hereinafter described. The transformer 201 consists of a primary winding, a secondary winding and an iron core. The current applied to the transformer 201 by conductors 118, 119 is fed to the center of the primary winding, while the aforementioned device 203 switches the current path, thereby to cause the current to leave the primary winding alternately through one and the other of the two end terminals of said primary winding, and thereby periodically reversing the direction of the magnetic flux in the iron core of the transformer 201, so as to induce an A.C. voltage in the secondary winding.

The A.C. voltage is rectified in the rectifier bridge 202 to a pulsating direct voltage, which is applied to the means 200 for storing energy therein. The device 203 is arranged to be made automatically inoperative when the desired amount of energy has been stored in the means 200. To this end a voltage corresponding to the amount of energy stored is taken out from the means 200, for example by means of a voltage divider 204, said voltage being compared in a comparator 205 with a voltage given by a reference voltage source 206. The reference voltage is selected so as to agree with the voltage given by the voltage divider 204 when the desired amount of energy is stored in the means 200. The comparator 205 includes a switch means for interrupting the operating current to the device 203 when the voltage given by the voltage divider 204 reaches the same value as the reference voltage. The current for energizing the reference voltage source 206 and the comparator 205 is taken out upstream of the transformer 201 via a voltage regulator 207 wherewith the comparator 205 delivers, via its switch means, the requisite driving current for the device 203, provided that the voltage given by the voltage divider 204 is lower than the reference voltage.

The comparator switch is arranged to interrupt passage of the operating current to the device 203 when the requisite amount of energy is contained in the means 200, and to close instead a circuit through which operating current is applied to a second current path switching device 208 of the same type as the device 203, the device 208 driving a transformer 209 provided with an iron core, in essentially the same manner as the device 203. The transformer 208 receives the current arriving from conductors 118, 119 at the center of the primary winding, while the current path switching device 208 causes the current to leave the primary winding alternately through one and the other of the end terminals thereof, so as to generate an A.C. voltage in the secondary winding. The center of the secondary winding is earthed and its ends are connected to a conventional rectifier bridge 210 for full wave rectification. The positive and negative pulses leaving the bridge 210 are smoothed in smoothing devices 211, 212 and are processed in voltage regulators 213, 214 in the manner described above with reference to components 109–112, so that the output conductors 215, 216 obtain a substantially constant voltage for supply of current to the current consuming components of the ignition apparatus, as hereinafter described.

As previously mentioned, the ignition apparatus is provided with confirmation means, by means of which information is received at the control unit shown in FIG. 6 to the effect that the desired amount of energy has been stored in means 200. The confirmation means comprises an oscillator 217 which is energized by current from conductor 215 or 216 and which is arranged to transmit a confirmation signal in the form of an A.C. voltage having a frequency such that it is detected by the detector 128 of the control unit, thereby causing the lamp 129 to be illuminated. The confirmation signal is transmitted through conductors 118, 119. For the reasons given above in the description of the control unit, the confirmation signal is passed to the conductor 118, 119 via a low-pass filter 218, a matching transformer 219 and capacitors 220. For reasons which will be evident from the aforegoing, chokes 221 are connected upstream of components 201, 207, 209 in the illustrated manner.

It will be understood that, in practice the control unit and the ignition apparatus are normally spaced far apart and that at least the ignition apparatus must have the form of a portable unit. The conductors 118, 119 are therefore detachably connected to at least the ignition apparatus and suitably also to the control unit by means of connecting means (not shown). Since, when connecting the control device to the ignition apparatus through conductors 118, 119, there is a risk of unintentionally reversing the polarities, for example the ignition apparatus connector intended for conductor 118 is instead connected to conductor 119, and since the ignition apparatus components 207, 203, 205 and 206, which are supplied with a D.C. voltage, must have a predetermined polarity, there is connected upstream of said components a selective pole changer 222 adapted to reverse the polarity on the output current from the choke 221 if the ignition apparatus is wrongly connected to the conductors 118, 119.

Upon recepit of the confirmation signal in the control unit, the ignition apparatus can be caused to fire electric detonators (not shown) connected in series between the terminals 223, 224. This is effected by pressing a button corresponding to the ignition apparatus in the button bank 125 of the control unit, wherewith the shift register 124 is adjusted so that upon manual closing of the switch means 115, the control unit will transmit and activating signal which is generated by the signal source 116 and the frequency of which is changed by the frequecy divider 117 in correspondence to the setting of the shift register. This signal is passed via conductors 118, 119, capacitors 220 and a matching transformer 225 to a detector 226 which is tuned to the frequency of the actuating signal, said detector being of the type, for example, as that sold by Signetics International Corp., London, England under the designation NE 567. Upon receipt of the activating signal, the detector 226, which is energized with current from conductor 215, transmits a direct current via a conductor 227 to a device 228, which is supplied with current through a conductor 229 from the energy storing device 200 and which is capable of driving a substantially constant pre-determined current through the electric detonator match heads irrespective of the number of detonators connected between the terminals 223, 224. Alternative embodiments of the device 228 are shown in FIGS. 8–11.

With the embodiment of FIG. 8, the conductor 229 extending from the energy storing device 200 is connected to a normally open switch means 301 which can be closed by means of a gate 302. The conductor 227 extending from detector 226 is connected to a time circuit 303, which is adapted to produce a D.C. voltage signal during the time required to ignite the match heads. The time circuit 303 may be of the type sold by T.I. under the designation SN 74121 N. and is arranged to activate through one output thereof a second time circuit 304, which is of the same type as time circuit 303, and a bistable flip flop 305, for example such as that sold by T.I. under the designation SN 7472 N, while the other output of the time circuit 303 is arranged to activate gate 302 which closes switch means 301 via an activating device (not shown) in the form of a relay for example. Thus, provided that electric detonators are connected between terminals 223 and 224, current can flow in this way from the positive terminal of the energy storage means 200, via the closed switch means 301 through the terminal 223, the connected electric detonators and the terminal 224, and through a constant current device, comprising transistors 306, 307 and resistors 308, 309, back to the negative terminal of the means 200.

The purpose of the constant current device is to limit the current delivered by the energy storage means 200 to a value recommended for the electric detonators connected to the ignition apparatus. This value, the so called series-ignition current, shall be reached irrespective of the number of detonators connected, provided that said number falls within the maximum number of detonators for which the ignition apparatus is designed to handle. The resistors 308, 309 are so adjusted in relation to each other that the current through the constant current device flows mainly through the transistor 306 and resistor 309. By changing the ability of the transistor 306 to allow current to pass therethrough, the current is controlled through the main current circuit of the constant current device. The control current required to effect this regulation flows from the terminal 224 through the resistor 308 and into the base of transistor 306, although the control current can be deflected either totally or partially by means of transistor 307. This change in the control current of transistor 306 takes place in dependence of the voltage occurring over the resistor 309 due to the current flowing therethrough, said voltage being a measurement of the current through the connected detonators. The resistor 309 also serves as a current supply device for a circuit breaking circuit arranged to stop, under certain conditions, current from flowing through the detonators before an amount of energy sufficient for firing the same has been applied thereto. To this end the voltage occurring over resistor 309, said voltage being as mentioned a measurement of the current flowing through the detonators, is applied to the comparator 310, where it is compared with a reference voltage produced by a reference voltage device 311, said reference voltage being selected so that the voltage over the resistor 309 is equal to the reference voltage when the current through the connected detonators reaches the desired value. If this value is not reached within a certain period of time after initiating a detonator firing sequence, there is reason to suspect that a fault has occured in the circuit. For example, the firing circuit may have short circuited or the number of detonators connected to the ignition apparatus may exceed the maximum number which the apparatus can handle. The time circuit 304 is provided to check the possible occurrence of a fault, and is arranged to energize one input of a two-input NOR-gate 312, for example of the type sold by T.I. under the designation SN 7402 N, which gate is blocked during the pulse time of the time circuit 304 and the second input of which gate 312 is connected to the bistable flip-flop 305. The flip-flop 305 is set to "zero" prior to initiating the detonator firing sequence, but can be arranged to be set to "one" by the comparator 310 when the current to the detonators reaches the desired value. Should the current through the match heads fail to reach the desired value before blocking of the gaate 312 by means of time circuit 304 ceasing, the gate 312 will block the gate 302, thereby causing switch means 301 to open and the flow of current to the detonators to stop.

Figure 9:
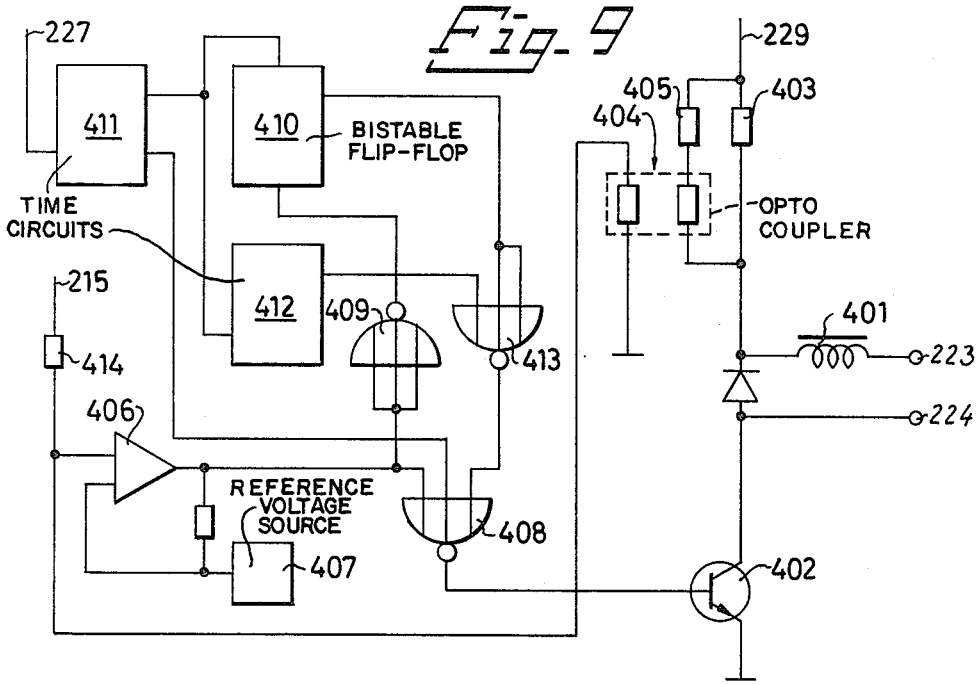

Another embodiment of the device 228 is shown in FIG. 9, with which embodiment the constant current device includes a choke 401 and a transistor 402. Owing to the fact that the choke is able to store a certain amount of energy, the transistor 402 is used in a manner whereby it is either conductive or totally non-conductive, the power losses in the constant current device being, as a result thereof, slight in comparison with the embodiment shown in FIG. 8. On the other hand, the current through the detonator match heads will vary slightly more than with the embodiment of FIG. 8. Since the high voltage delivered by the means 200, which has the form of a capacitor-pack, may well render components located downstream thereof unserviceable, the circuit includes a current measuring resistor 403 which is isolated by means of the primary side of an optical coupler 404 connected in series with a protective resistor 405, wherewith coupling between the primary and secondary sides of the coupler is effected by means of infrared light, which enables the transmission of information to a comparator 406 concerning the D.C. current flowing through the electric detonator match heads. The secondary side of the coupler 404 is connected in series with a resistor 414 and current is supplied thereto from conductor 215. The comparator 406 is connected to the junction between the resistor 414 and the secondary side of the coupler 404 and is arranged to compare the voltage in the junction point with a reference voltage produced by a reference voltage device 407, and in turn energizes and deenergizes the transistor 402 by means of the gate 408. With the embodiment of FIG. 9, the signal from the comparator 406 is inverted in gate 409 and applied to a bistable flip-flop 410. The components 410–413 have the same mode of operation as those described with reference to circuits 303–305, 312 in FIG. 8.

With the embodiments of FIGS. 8 and 9, the energy storage means 200 must be charged to a level reaching at least the voltage required to drive the desired current through the greatest number of electric detonators for which the ignition apparatus is designed to handle. The voltage delivered by the means 200 falls, however, owing to the discharging of the device. In order to be able to drive the desired current through the match heads at the end of a detonator firing sequence, if the ignition apparatus is to be used to initiate simultaneous detonation of a large number of electric detonators, the energy storage apparatus 200 must either be made very large, which means that it will be heavy, or must initially be charged to a high voltage, which may result in overloading of the constant current device as a result of high voltages and heavy currents.

Figure 10:
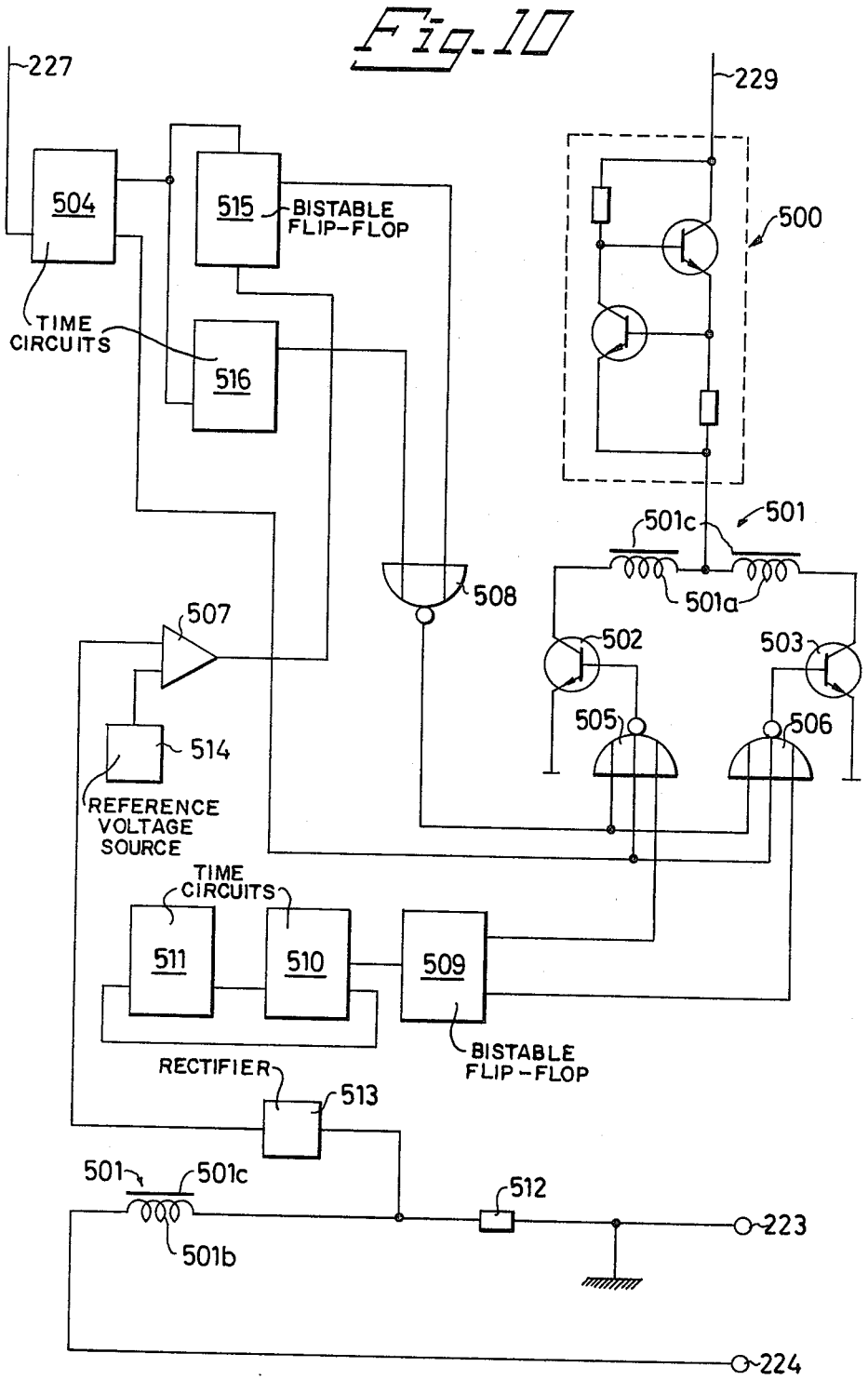

With the embodiment of FIG. 10, the conductor 229 extending from the means 200 is connected to a constant current device 500 having in principle the same design as the constant current device described with reference to FIG. 8. The embodiment of FIG. 10 also includes a transformer 501 having two primary windings 501*a*, a secondary winding 501*b* and an iron core 501*c*. Current from the constant current device is fed to the connection between the primary windings and leaves the transformer alternately through one and the other of the two output terminals and two transistors 502, 503 connected to transformer 501. As with the embodiments previously described, a time circuit 504 connected to detector 226 (FIG. 7) is energized by means of the signal delivered by said detector via conductor 227. Connected to the transistors 502, 503 are NOR-gates 505, 506 which have three inputs and which may be of the type sold by T.I. under the designation SN 7427 N. One input of said gates is driven by time circuit 504 and a second input is driven by a gate 508 forming part of the circuit breaking circuit, while the third input is connected to the two outputs of a bistable flip-flop 509 respectively. Owing to the fact that the state of the flip-flop 509 is changed when pulses from an oscillator comprising time circuits 510 and 511 are applied to the intended input of said flip-flop 509, the gates 505, 506 will be alternately opened and closed, whereby transistors 502, 503 are alternately switched on and off and current from the positive terminal of the means 200 is passed alternately through the primary winding 501*a* and the associated transistor of the transformer 501 to the negative terminal of said means 200. Due to this alternating passage of the current through the primary windings 501*a* the magnetic flux in transformer 501 is reversed and an A.C. voltage is induced in the secondary winding of the transformer. This A.C. voltage is applied to terminals 223, 224, whereupon an alternating current flows through the match heads of the electric detonators connected between terminals 223, 224. This alternating current also flows through a current measuring resistor 512. Since the frequency of the alternating current is high, the filament in the match head is heated to the same extent as when a direct current is used.

The resistor 512 is connected as shown to earth on the side thereof which is connected to terminal 223, and hence the A.C. voltage occurring over the resistor can be applied to a comparator 507 subsequent to being rectified by means of a bridge rectifier 513, said comparator being arranged to compare the voltage received with a reference voltage produced by a reference voltage source 514 connected to said comparator. The comparator 507 is connected to a flip-flop 515 of the circuit breaking circuit. As will be seen, the circuit breaking circuit includes components 508, 515 and 516, the mode of operation of which is the same as that of components 304, 305 and 312 described with reference to FIG. 8.

Figure 11:
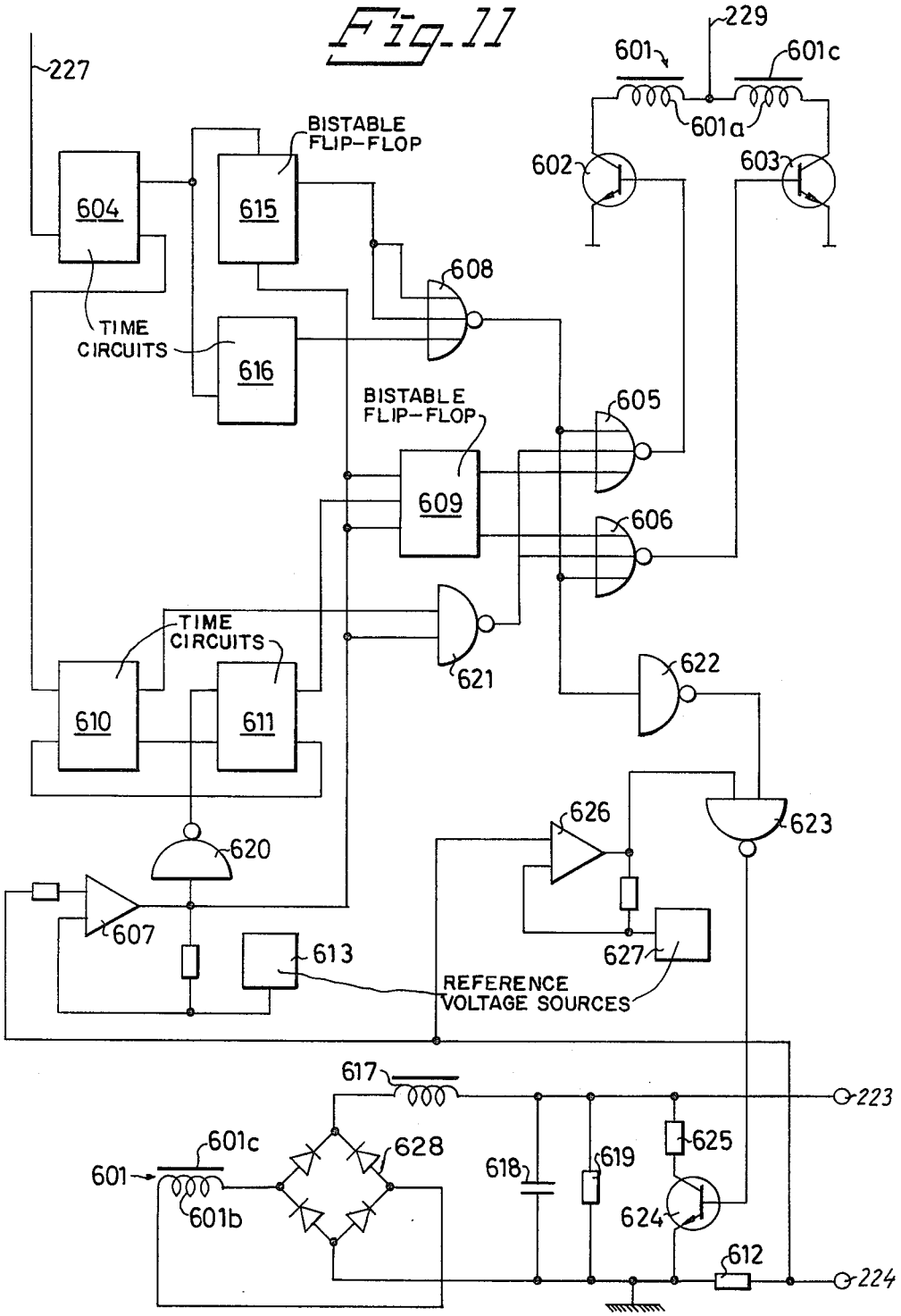

With the embodiment of FIG. 11, the conductor 229 extending from the means 200 is connected to the center of the primary winding of a transformer 601 which is connected to gates 605, 606 via transistors 602 and 603. The components 601–612 of the embodiment shown in FIG. 11 have the same purpose and the same mode of operation as corresponding components 501–512 described with reference to FIG. 10.

The outputs of gates 605, 606 are controlled by means of a NAND-gate 621 having two inputs, for example a NAND-gate of the type sold by TI under the designation SN 7400 N, the one input of which gate is connected to a time circuit 610 of an oscillator circuit comprising components 610, 611 and the other input of which is connected to the output of a comparator 607 which is connected to a flip-flop 609 co-operating with gates 605, 606. To maintain the current flowing through the detonator match heads connected between terminals 223, 224 substantially constant, there is provided a rectifier 628, a choke 617 and a capacitor 618 for smoothing the rectified current, said components 628, 617 and 618 being connected in the manner shown. Also provided is a protective resistor 619, which is incorporated in the circuit to restrict the voltage occurring with the possible break in the circuit incorporating the detonator to a safe magnitude. When the current through the detonator match heads reaches the desired value, the voltage over the resistor 612 will be equal to the reference voltage given by a reference voltage scource 613 and the output of comparator 607 will block a time circuit 611 by means of an inverter step 620, said circuit 611 also being connected to flip-flop 609 as shown. No new pulses are set by time circuit 611 for triggering the bistable flip-flop 609 when this state is reached. With the embodiment of FIG. 11, activation of the NAND-gate 621 will cause the gates 605, 606 to be blocked until the voltage over resistor 612 has fallen to a level beneath the reference voltage level. When the voltage over the resistor 612 falls below the reference voltage, the comparator 607 triggers the time circuit 611 by means of the inverter step 620, which circuit 611 in turn transmits a pulse to the bistable flip-flop 609, causing the state of said flip-flop to change, at the same time as one of the transistors 602, 603 is made conductive by means of the gate 621, which controls the gates 605, 606.

Thus, the current path switching device arranged to control the transformer 601 is inoperative for the time during which the current through the detonator match heads is equal with or greater than the desired value. The voltage on the means 200 gradually falls as a result of the electrical discharge thereof, which is compensated by the control arrangement shown in FIG. 11, owing to the fact that the pauses in the working of said current path switching device become shorter and shorter, to cease entirely when the means 200 is practically totally discharged. The gate 608 of the circuit breaking circuit is connected to gates 605, 606 and to a NAND-gate 623 over an inverter step 622, the NAND-gate 623 having two inputs and being of the type, for example, as that sold by T.I. under the designations SN 7400 N. When the output of gate 608 of the circuit breaking circuit is activated, the gates 605, 606 are blocked, which renders the transistor 602, 603 non-conductive and current no longer flows through the secondary winding 601*b* of the transformer 601. A certain amount of energy, however, is stored in choke 617 and capacitor 618. To enable this energy to be conducted away and to prevent possible further heating of the match head filaments, a transistor 624 is connected between terminal 223 and the conductor passing from the current measuring resistor 612 to the negative terminal of the rectifying bridge 628. When the gate 605 is activeted, the output of gate 623 is also activated, whereupon the transistor 624 conducts away energy stored in choke 617 and the capacitor 618.

If only a few electric detonators have been connected to the ignition apparatus, the voltage built up over the detonators may be too high so that current through the detonator match heads greatly exceeds the desired value. This build-up of excessive voltage is due to the fact that choke 617 stores energy and therewith delays the output currents. To prevent this the circuit includes a second comparator 626 which is arranged to compare the voltage arriving from the current measuring resistor 612 with a reference voltage generated by a reference voltage souce 627, said reference voltage being selected so that said voltages are equal when the current through the detonators exceeds the desired current by a certain value. The comparator 626 is arranged to activate the output of gate 623 which drives the transistor 624. In this way a part of the energy stored in the choke 617 and capacitor 618 is used in the resistance 625, thereby ensuring that current through the detonators does not exceed a certain value.

A rock blasting system incorporating the control unit of FIG. 6, the ignition apparatus of FIG. 7 and the current generator shown in FIG. 11 has been used in practice. The voltage applied to the control unit from the A.C. mains was 220 volts at a frequency of 50 Hz and was transformed in transformer 103 to 80 volts. The voltge taken out on terminals 118, 119 for charging the ignition apparatus was 100 volts D.C. and was transferred to said apparatus by an existing local telephone network. The voltage on transformer 104 was 2 × 12 volts A.C. and the voltage taken out on terminals 113, 114 for current supply to the involved logic circuits was + and − 5 volts D.C. respectively. The oscillator was a crystal controlled oscillator having a frequency of 1 MHz and the frequency range of the different activating signals was from 1000 -1300 Hz. The confirmation signal received from the ignition apparatus had a frequency of 850 Hz.

As a result of the resistance of the conductors connecting the cntrol unit to the ignition apparatus, the voltage taken out on terminals 118, 119 had fallen to about 50 volts. The energy storage device 200, which comprised seven capacitors, each of 1500 microfarads, was charged to a voltage of 350 volts. The voltage taken out on terminals 215, 216 for current supply to the logic circuits involved was + and − 5 volts respectively. The electric detonators fired by the apparatus were of the VA/MS type, sold by Nitro Nobel AB, Sweden, the filaments of which require a current of 3.5 amp. to effect reliable detonation of the detonators. The energy stored in the capacitors was approximately 640 WS. The pulse length of the ignition current generator was about 80 milliseconds and the voltage applied to the detonators was about 1200 volts, there being 100 detonators connected in series. The operating frequency of the current generator was 5 kHz.

It will readily be perceived that the rock blasting system incorporating the invention can be arranged to co-act with means which work against thunder or dangerous ground currents and/or which render the blasting system inoperable when thunder is imminent and/or when said dangerous ground currents exist.

What is claimed is:

1. An apparatus for igniting the match heads of a plurality of series-connected electric detonators, comprising a dischargeable electric energy source electrically connected to the ends of the series of detonators and supplying the requisite amount of energy for simultaneous firing of the maximum number of detonators for which said apparatus is dimensioned during the period of discharge of said energy source, means electrically connected to said source and said detonators for regulating the current through the detonator match heads during the energy source discharge period so as to retain a substantially constant pre-determined current value irrespective of the number of detonators served by said apparatus, and means for initiating the discharge of said source, said current regulation means including means for interrupting the passage of current through the detonator match head before discharging the energy source to an extent sufficient to fire any of the detonators, should the energy stored in the energy source be insufficient for firing of all detonators connected to said source.

2. An apparatus according to cliam 1, wherein said current regulating means comrises a transformer having a primary winding electrically connected to said electric energy source, a secondary winding and an iron core, the primary winding being provided with a center input and the secondary winding being connected to said electric detonators, the current through said secondary winding being substantially the same as the current through said electric detonators, and wherein there is provided means for periodically reversing the flow of current through the primary winding, a fixed resistance which is connected in series with the electric detonators, and an actuating means working in dependence of the voltage over said fixed resistance for energizing and deenergizing the current flow reversing means at such intervals that the current through the secondary winding and the detonator match heads during the discharge sequence of the energy source retains said pre-determined, substantially constant effective current value irrespective of variations in the voltage applied to the primary winding of the transformer.

3. An apparatus according to claim 2, wherein means are connected in series with the secondary winding of the transformer for rectifying an alternating current transmitted by the secondary winding and for smoothing the rectified current.

4. An apparatus according to claim 1, wherein said means for interrupting comprises a fixed resistance connected in series with the detonators, means for detecting the voltage over the fixed resistance and means controlled by said detecting means for blocking the supply of current to said detonators.

5. An apparatus according to claim 4, wherein means are provided for conducting away energy stored in a circuit incorporating said detonators when the supply of current to said detonators is blocked.

* * * * *